US005597684A

United States Patent [19]

Ikesu et al.

[11] Patent Number: 5,597,684

[45] Date of Patent: Jan. 28, 1997

[54] SILVER HALIDE COLOR PHOTOGRAPHIC LIGHT-SENSITIVE MATERIAL

[75] Inventors: Satoru Ikesu; Yutaka Kaneko, both of Tokyo, Japan

[73] Assignee: Konica Corporation, Japan

[21] Appl. No.: 562,687

[22] Filed: Nov. 27, 1995

[30] Foreign Application Priority Data

Nov. 29, 1994 [JP] Japan ..... 6-294898

[51] Int. Cl.[6] ..... G03C 7/34

[52] U.S. Cl. ..... 430/549; 430/553

[58] Field of Search ..... 430/553, 549

[56] References Cited

U.S. PATENT DOCUMENTS

| | | | |
|---|---|---|---|
| 4,863,840 | 9/1989 | Komorita et al. | 430/553 |
| 5,077,188 | 12/1991 | Tanji et al. | 430/553 |

FOREIGN PATENT DOCUMENTS

| | | | |
|---|---|---|---|
| 315148 | 11/1992 | Japan | 430/553 |
| 5173306 | 7/1993 | Japan | 430/553 |

*Primary Examiner*—Lee C. Wright

*Attorney, Agent, or Firm*—Jordan B. Bierman; Bierman and Muserlian

[57] ABSTRACT

A silver halide color photographic light sensitive material comprising a support having thereon a silver halide emulsion layer containing a cyan coupler represented by formula (I). The photographic material may further contain a cyan coupler represented by formula (II) or (III).

Formula (I)

Formula (II)

Formula (III)

6 Claims, No Drawings

SILVER HALIDE COLOR PHOTOGRAPHIC LIGHT-SENSITIVE MATERIAL

FIELD OF THE INVENTION

The present invention relates to a silver halide color photographic light sensitive material and particularly to a silver halide color photographic light sensitive material containing a cyan coupler improved in solubility and dispersion stability and capable of obtaining a dye image excellent in color reproduction and storage stability.

BACKGROUND OF THE INVENTION

In the process of forming a dye image with a silver halide color photographic light sensitive material (hereinafter, referred to a photographic material), a aromatic primary amine type color developing agent reduces exposed silver halide grains contained in the color photographic material and the resulting oxidation product of the developing agent reacts with a coupler contained in the color photographic material to form a dye. As a coupler are conventionally used three kinds of couplers of forming yellow, magenta and cyan dyes to color-reproduce based on subtractive color system.

Each of the couplers is conventionally dissolved in a high boiling organic solvent, if necessary, in combination with an auxiliary solvent to be added into a silver halide emulsion.

As a cyan coupler known in the photographic art are cited 2-acylamino-5-ethylphenol type cyan coupler which is substituted by an acylamino group at 2-position of phenol and 2,5-diacylaminophenol type cyan coupler which is substituted by an acylamino group at the 2- and 5-position. A color dye image formed from the former copler, however, is insufficient in dark-keeping dye stability and the latter, insufficient in light fastness and color reproduction so that there has been desired further improvements thereof. Therefore, an object of the present invention is to provide a silver halide color photographic light sensitive material containing a cyan coupler superior in dark fastness and light fastness of the color dye image formed as well as color reproduction thereof.

SUMMARY OF THE INVENTION

The object of the invention can be achieved by the following embodiments.

1. A silver halide color photographic light sensitive material containing a cyan coupler represented by the following formula (I).

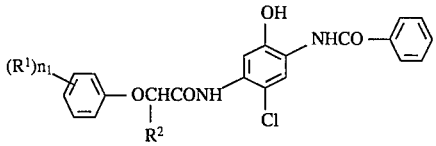

Formula (I)

In the formula, $R^1$ represents an unsubstituted alkyl group, which may be branched; $R^2$ represents a hydrogen atom or an unsubstituted alkyl group having 1 to 10 carbon atoms, which may be branched; $n_1$ is an integer of 1 to 5.

2. A silver halide color photographic light sensitive material containing a cyan coupler represented by the above-described formula (I) and further a cyan coupler represented by the following formula (II).

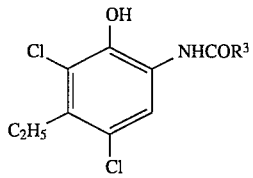

Formula (II)

In the formula, $R^3$ represents an alkyl group, which may be substituted.

3. A silver halide color photographic light sensitive material containing a cyan coupler represented by the above-described formula (I) and further a cyan coupler represented by the following formula (III).

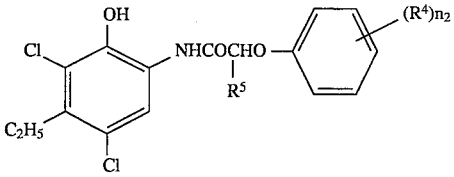

Formula (III)

In the formula, $R_4$ represents an unsubstituted alkyl group; $R^5$ represents a hydrogen atom or an alkyl group having 1 to 10 carbon atoms, which may be substituted; $n_2$ is the same as $n_1$ above-defined.

DETAILED DESCRIPTION OF THE INVENTION

First, an explanation is provided with regard to the cyan coupler represented by the formula (I).

In the formula, $R^1$ represents an unsubstituted alkyl group; $R^2$ represents a hydrogen atom or an unsubstituted alkyl group having 1 to 10 carbon atoms which is branched or unbranched; $n_1$ is an integer of 1 to 5.

$R^1$ has preferably 1 to 15 carbon atoms, and more preferably, 1 to 8 carbon atoms. Furthermore preferably, $R^1$ is a branched, unsubstituted alkyl group having 4 or 5 carbon atoms. As examples of an alkyl group represented by $R^1$ are cited a methyl, ethyl isopropyl, t-butyl, t-amyl, octyl, and pentadecyl. As examples of an alkyl group represented by $R^2$ are cited methyl, ethyl, isopropyl, butyl hexyl and decyl.

Examples of thre cyan coupler represented by the formula (I) are shown as follows, but the present invention is not limited thereto.

(I)-1

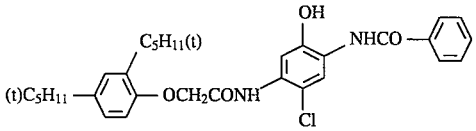

(I)-2

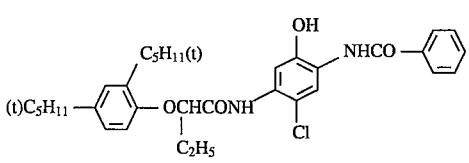

(I)-3

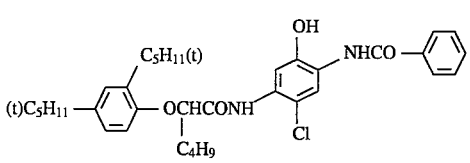

-continued (I)-4

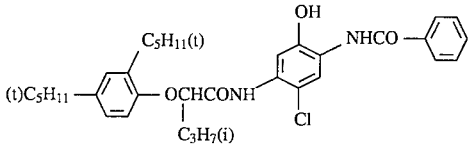

(I)-5

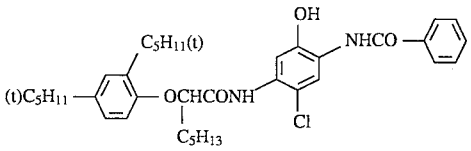

(I)-6

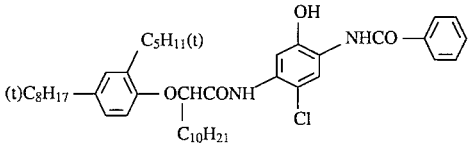

(I)-7

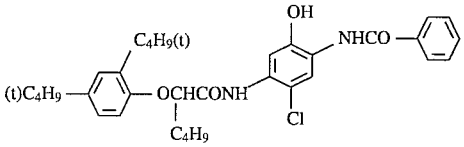

(I)-8

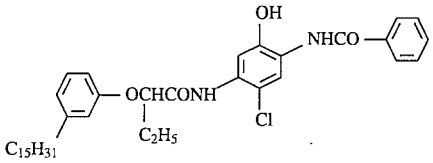

(I)-9

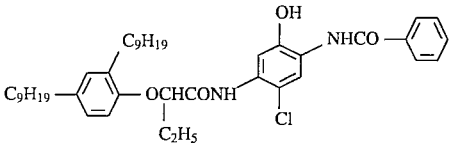

(I)-10

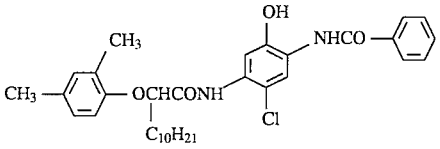

(I)-11

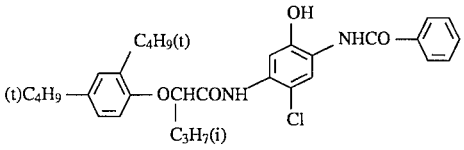

(I)-12

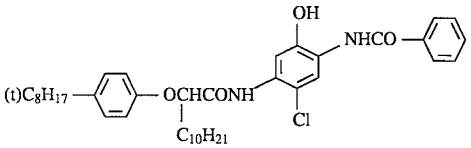

Synthesis Example:

Exemplified Compound (I)-2 was synthesized according to the following scheme.

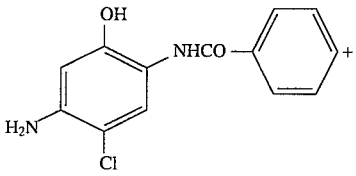

.HCl Intermediate (1)

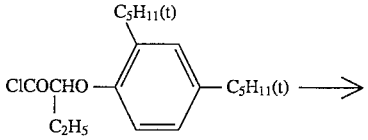

Intermediate (2)

Exemplified Compound (I)-2

Intermediate (1) of 80 g was dispersed in ethyl acetate and thereto was added dimethylaniline of 68.0 g (0.561 mol). Thereafter, Intermediate (2) of 95 g (0,280 mol) was added dropwise thereto. After the addition, the reaction mixture was heated under reflux further for two hours. After completing the reaction, undissolved substance was filtered and washed with diluted hydrochloric acid, then with water and dried to be concentrated. The resulting residue was subjected to recrystalization in acetonitrile to obtain exemplified Compound (I)-2 of 136 g (90% yield). The melting point thereof was found to be within 164° to 166° C.. and the structure was identified by $^1$H-NMR and Mass-spectrometry.

The cyan coupler of the invention may be used in combination with a cyan coupler known in the art. Inventors of the present invention found that, in a silver halide color photographic material comprising a support having thereon a silver halide emulsion layer containing a cyan coupler represented by the formula (I), or a combination thereof with a cyan coupler representedby the formula (II) or (III), improvements in not only dark stability and light fastness of the color dye image but also color reproduction and color forming property were achieved.

With regard to the cyan coupler represented by formula (II), explanation.will be provided as below.

In the formula, $R^3$ represents an alkyl group, preferably having 8 to 36 carbon atoms. As examples of an unsubstituted alkyl group are cited octyl and dodecyl. $R^3$ may be substitutedby one or more substituents. As examples of the substituent are cited a halogen atom such as fluorine, chlorine or bromine, a hydroxy group, carboxy group, alkyl group such as methyl, ethyl, propyl, butyl octyl or dodecyl, aralkyl group, cyano group, nitro group, alkoxy group such as methoxy or ethoxy, aryloxy group, alkylsulfonamide group such as methylsulfonamide or octylsulfonamide, arylsulfonamide such as phenylsulfonamide or naphthylsulfonamide, alkylsufamoyl group such as butylsulfamoyl, arylsulfamoyl group such as phenylsulfamoyl, alkyloxycarbonyl group such as methyloxycarbonyl, aryloxycarbonyl group such as phenyloxycarbonyl, aminosulfonamide group such as dimethylaminosulfonamide, alkylsulfonyl group, arylsulfonyl group, alkylcarbonyl group, arylcarbonyl group, aminocarbonylamide group, carbamoyl group, and sulfinyl group. These group may be introduced in combination thereof.

In the invention, a cyan coupler represented by formula (II) is preferably represented by formula (III).

Next, as to the cyan coupler represented by formula (III), explanation will be provided.

In the formula, $R^4$ represents an unsubstituted alkyl group, which has preferably 1 to 15 carbon atoms and more preferably, 1 to 8 carbon atoms. Furthermore preferably, $R^4$ is an unsubstituted alkyl group having 4 ot 5 carbon atoms. Examples thereof include methyl, ethyl, isopropyl, t-butyl, t-amyl, octyl or dodecyl. Preferably it is t-butyl, t-amyl or octyl. $R^5$ represents a hydrogen atom or an unsubstituted alkyl group having 1 to 10 carbon atoms, which is branched or unbranched. $n_2$ is the same as $n_1$ defined in formula (I).

Examples of cyan couplers represented by formulas (II) and (III) are shown below but the present invnention is not limited thereto.

(II)-1

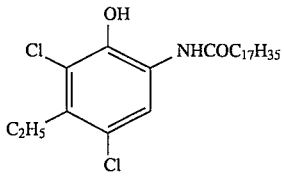

(II)-2

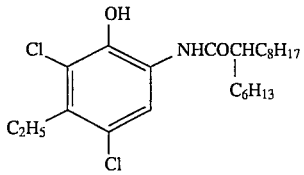

(II)-3

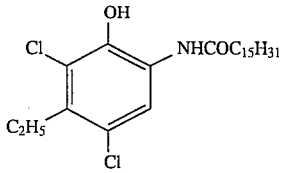

(II)-4

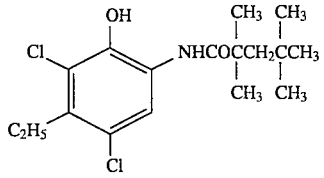

(II)-5

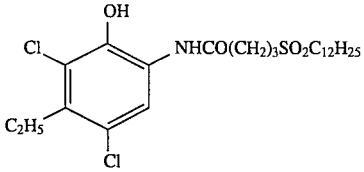

(II)-6

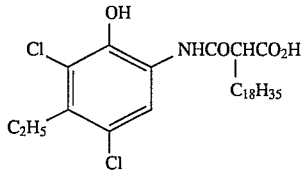

-continued (II)-7

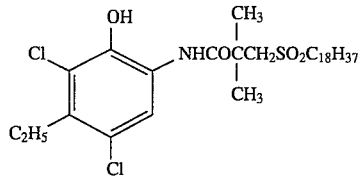

(II)-8

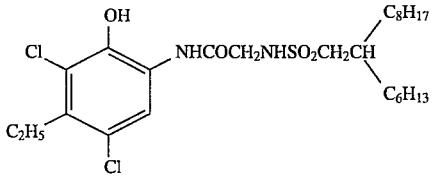

(II)-9

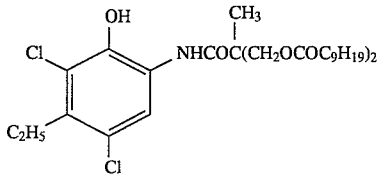

(II)-10

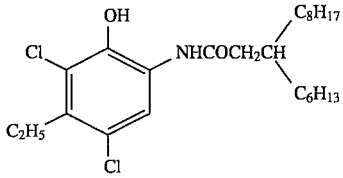

(III)-1

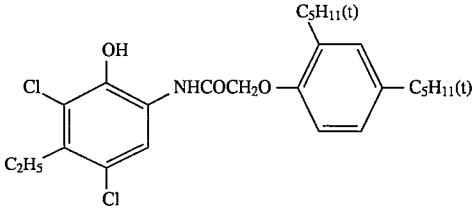

(III)-2

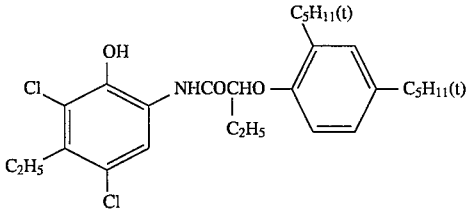

(III)-3

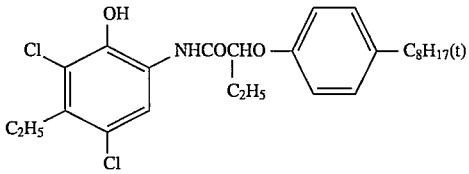

(III)-4

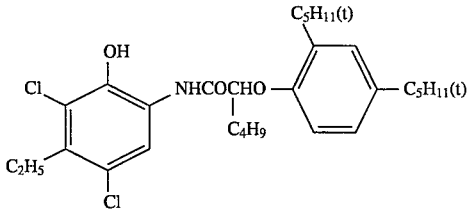

-continued (III)-5

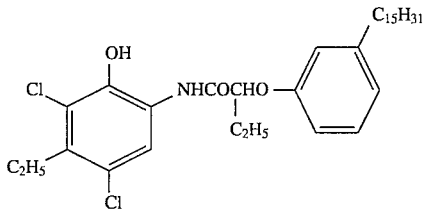

(III)-6

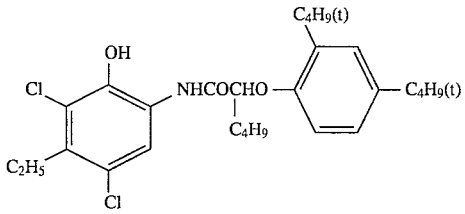

(III)-7

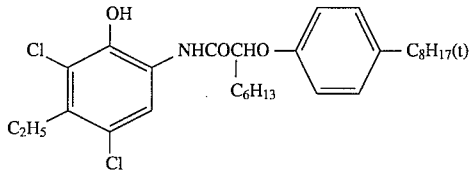

(III)-8

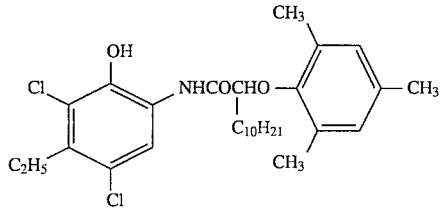

(III)-9

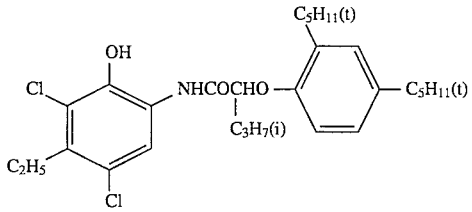

These compound can be readily synthesized according to a method known in the art as described in Japanese Patent examined 3-71700 (1991).

In the present invention, a cyan coupler represented by formula (I) is optionally contained, preferably in an amount of 0.03 to 0.5 g and more preferably, 0.05 to 0.15 g per $m^2$ of the photographic material. In the case when a cyan coupler represented by formula (I) is used in combination with a cyan coupler representedby formula (II) or (III), the amount may be optional. The proportion of the cyan coupler of formula (I) is preferably 10 to 50 mol %, more preferably 10 to 30 mol%, based on the total cyan coupler.

The silver halide color photographic light sensitive material of the invention comprises a support having thereon a silver halide emulsion layer, including a color negative or positive film, color print paper, color slide, or photographic material for a specific use such as printing, radio-graphy or high resolution.

A photographic light sensitive material containing a coupler of the invention such as a color printing paper may be used for monocolor or multicolor photography. In the multicolor photographic light sensitive material, the coupler of the invention can be contained in any layer thereof and usually contained in a red-sensitive silver halide emulsion. The multicolor photographic light sensitive material comprises dye image-forming component units having sensitivity respectively to each of three primary color ranges of spectrum. The component unit comprises a single- or multi-layer having sensitivity to a spectral range. Component layers of the photographic materials including an image forming component layer can be arranged in the various order as known in the art.

Typical multicolor photographic light sensitive material comprises a support having thereon a cyan dye image forming component unit comprising a red-sensitive silver halide emulsion layer containing a cyan coupler (containing at least a coupler of the invention), a magenta dye image forming component unit comprising green-sensitive silver halide emulsion layer containing a magenta coupler and a yellow dye image forming component unit comprising a blue-sensitive silver halide emulsion layer containing a yellow coupler.

The photographic light sensitive material of the invention can further comprise additional layer such as a filter layer, interlayer, protective layer and undercoat-layer.

The inventive coupler can be contained in an emulsion according to a conventional method known in the art. For example, the coupler is dissolved in a high boiling organic solvent having a boiling point of 175° C. or higher such as tricresyl phosphate or dibutyl phthalate, a low boiling solvent, or a mixture solution thereof. The resulting solution was mixed with a gelatin solution containing a surfactant and the mixture was emulsified by means of a high-revolving mixer or colloid mill. The emulsion obtained was added into a silver halide emulsion.

Silver halide used in a photographic light sensitive material containing the inventive coupler is preferably silver chloride, silver bromochloride or silver iodobromochloride. A blended mixture thereof such as a mixture of silver chloride and silver bromide can be used. In the case when a silver halide is used for a color print paper, the silver halide contains preferably chloride and therefore, silver chloride, silver chlorobromide and silver iodochlorobromide each containing 1% or more chloride are particularly preferable.

The silver halide emulsion can be chemically sensitized accoding to a conventional method. The emulsion can be spectrally sensitized to a desired spectral range.

To the silver halide emulsion, there can be added a compound known in the art as a fog inhibitor or stabilizer used for the purpose of preventing fogging during the couse of preparation, storage or processing of the photographic light sensitive material.

To the photographic light sensitive material of the invention, there can be added a color stain preventing agent, dye image stabilizing agent, UV absorbent, antistatic agent, mattinf agent or surfactant as used in a conventional photographic light sensitive material.

These additive are referred, for example, to Research Disclosure, Vol. 176, pages 22–31 (December 1978).

The photographic light sensitive material containing an inventive coupler can be subjected to color developement known in the art to form an image.

The photographic light sensitive material containing an inventive coupler may futher contain a color developing agent or precursor thereof in a hydrophilic colloidal layer. In this case, the photographic material is processed in a alkaline activator bath.

The photographic light sensitive material containing an inventive coupler is, after color development, further subjected to bleaching and fixing. Bleaching and fixing may be onducted simultaneously.

After fixing, usually, washing is carried out. Instead of washing, stabilizing may be conducted.

EXAMPLES

Embodiments ofthe present invention will be explained as below, and the invention is not limited thereto.

Example 1

On a paper support on both sides thereof laminated with polyethylene, the following layers were coated in this order from the support to prepare a red-sensitive color photographic light sensitive material Sample 1. Unless otherwise noted, the addition amount of each compound was expressed in terms of per $m^2$ of the photographic material. The amount of silver halide was shown as a silver-converted value.

1st layer: Emulsion layer

A red-sensitive emulsion layer comprising 1.3 g of gelatin, 0.21 g of a red-sensitive silver halide emulsion containing 99.5 mol % chloride, $9.1\times10^{-4}$ mol of comparative coupler C-1 (hereinafter referred to comparative cyan coupler or comparative C-1) dissolved in 0.45 g of dioctyl phosphate 2nd layer: Protective layer A protective layer containing 0.50 g of gelatin. As a hardener, 2,4-dichloro-6-hydroxy-s-triazine sodium salt was added thereto in an amount of 0.017 g per g of gelatin.

Inventive Samples 2 to 7 were prepared in the same manner as Sample 1, except that comparative coupler C-1 was replaced by an equimolar amount of a coupler as shown in Table 1.

Samples 1 to 7 were each exposed through an optical wedge and processed accoding to the following steps.

The processing condition is as follows.

| Processing step | Temperature (°C.) | Time (sec.) |
|---|---|---|
| Color developing | 35.0 ± 0.3 | 45 |
| Bleach-fix | 35.0 ± 0.5 | 45 |
| Stabilizing | 30 to 40 | 90 |
| Drying | 60 to 80 | 60 |

Color developer

| | |
|---|---|
| Water | 800 ml |
| Triethanol amine | 10 g |
| N,N-diethylhydroxyamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Diethylene glycol | 10 g |
| N-ethyl-N-β-methnesulfonamidoethyl-3-methyl-4-aminoaniline sulfate | 4.5 g |
| Brightener (4,4-diaminostilbene sulfonic acid derivative) | 1.0 g |
| Potassium carbonate | 27 g |

Water was added to make 1 liter and the pH was adjusted to 10.10.

Bleach-fixer

| | |
|---|---|
| Ethylenediaminetetraacetic acid ferric ammonium salt, dihydride | 60 g |
| Ethylenediaminetetraacetic acid | 3 g |
| Ammonium thiosulfate (70% aq. solution) | 100 ml |
| Ammonium sulfite (40% aq. solution) | 27.5 ml |

Water was added to make 1 liter the pH was adjusted to 5.7 with potassium carbonate or glacial acetic acid.

Stabilizer

| | |
|---|---|
| 5-Chloro-2-methyl-4-isothiazoline-3-one | 0.2 g |
| 1,2-Benzisothiazoline-3-one | 0.3 g |
| Ethylene glycol | 1.0 g |
| 1-Hydroxyethylidene-1,1-diphosphonic acid | 2.0 g |
| o-Phenylphenol, sodium salt | 1.0 g |
| Ethylenediaminetetraacetic acid | 1.0 g |
| Ammonium hydroxide (20% aq. solution) | 3.0 g |
| Brightener (4,4-diaminostilbene sulfonic acid derivative) | 1.5 g |

Water was added to make 1 liter and the pH was adjusted to 7.0 with sulfiric acid or potassium hydroxide.

Samples 1 to 7 processed were sensitometrically measured with a desitometer (Type KD-7, product of Konica) and then allowed to stand under the condition of a high temperature and high humidity (60° C., 80% R.H.) to examine heat and moisture resistance of the resulting color dye omage (i.e., dark-keeping dye stability).

Separately, samples processed were exposed to xenon lamp for 10 days using Xenon phedo-O-meter and then subjected to sensitometry to examine light-keeping dye stability. Results thereof are shown in Table 1, in which the dark stability and light stabilty were each expressed in terms of a residual ratio (%) of the dye having an intial density of 1.0.

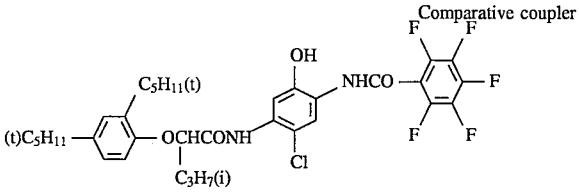

TABLE 1

| Sample No. | Coupler | Dye residual ratio: Dark stability | Dye residual ratio: Light stability | Remarks |
|---|---|---|---|---|
| 1 | Comparative C-1 | 93 | 65 | Comp. |
| 2 | (III)-2 | 58 | 79 | Comp. |
| 3 | (I)-1 | 94 | 76 | Inv. |
| 4 | (I)-2 | 95 | 75 | Inv. |
| 5 | (I)-4 | 95 | 78 | Inv. |
| 6 | (I)-8 | 97 | 79 | Inv. |
| 7 | (I)-12 | 97 | 78 | Inv. |

As can be seen from Table 1, Samples containing an inventive cyan coupler were higher in dye residual ratio and superior in the dark-keeping stability (heat and moisture resistance) and light-kepping stability of the dye and fast, as compared to a comparative sample containing a coupler C-1. Moreover, samples containing an inventive coupler were shown to be superior in the dark stability and light fastness.

Example 2

Sample 8 was prepared in the same manner as Sample 1. Sample 9 to 18 were prepared in the same manner as Sample 8, except that comparative coupler C-1 was replacedby equimolar coupler(s) as shown in Table 2, provided that, if two kinds of couplers were employed, the molar ratio of Coupler a and b of the table was 1:4.

In a similar manner to Example 1, Samples 8 to 18 were exposed and processed and the samples were sensitometrically measured using a densitometer (Type KD-7, product of Konica). Samples processed, further, were visually evaluated with respect to color reproduction of the color dye image according to the following criteria.

5: Exacellent

4: Good

3: Normal

2: Slightly poor

1: Poor

Furthermore, samples were tested with respect to the dark and light stability in a similar manner to Example 1. Results thereof are shown in Table 2.

TABLE 2

| Sample | Coupler | | | Color repro | Dye residual ratio (%) | | |
|---|---|---|---|---|---|---|---|
| No. | a | b | Dmax | duction | Drak | Light | Remarks |
| 8 | Comp. C-1 | | 2.35 | 3 | 93 | 64 | Comp. |
| 9 | Comp. C-1 | Inv. (III)-2 | 2.57 | 4 | 91 | 77 | Comp. |
| 10 | Comp. (III)-2 | | 2.61 | 4–5 | 60 | 77 | Comp. |
| 11 | Inv. (I)-2 | | 2.38 | 3 | 95 | 73 | Inv. |
| 12 | Inv. (I)-2 | Inv. (II)-5 | 2.59 | 4 | 92 | 80 | Inv. |
| 13 | Inv. (I)-3 | | 2.36 | 3 | 97 | 75 | Inv. |
| 14 | Inv. (I)-3 | Inv. (II)-5 | 2.57 | 4–5 | 96 | 80 | Inv. |
| 15 | Inv. (I)-7 | | 2.34 | 3 | 95 | 73 | Inv. |
| 16 | Inv. (I)-7 | Inv. (III)-2 | 2.62 | 5 | 93 | 82 | Inv. |
| 17 | Inv. (I)-12 | | 2.35 | 2–3 | 97 | 75 | Inv. |
| 18 | Inv. (I)-12 | Inv. (III)-2 | 2.63 | 5 | 97 | 80 | Inv. |

As can be seen from Table 2, samples containing an inventive cyan coupler were not only excellent in dye fastness (i.e., higher in the dye residual ratio) as compared to comparative samples 8 and 10 containing coupler C-1 or (III)-2, but also a combined use of a cyan coupler of formula (I) with a coupler of formula (II) or (III) led to a color dye image excellent in color reproduction. Particularly, a combination use of a coupler of formula (III) with a coupler of formula (I) achieved an enhanced improvement in color reproduction of the color image, as compared to that of the copler of formula (III) with the compartive coupler C-1. This was attributed unexpectedly to a synergistic effect of a coupler of formula (II) or (III) combined with a coupler of formula (I). It was also shown therefrom that the inventive samples displayer remarkably satisfactory characteriatics in light- keeping and dark-keeping stability (heat and moisture resistance) of the dye.

Example 3

On a paper support one side of which is laminated with polyethylene and another side is laminated with polyethylene containing titanium dioxide, component layers having the following compositions were coated on the side laminated with polyethylene containing titanium dioxide to prepare a multilayered silver halide photographic light sensitive material Sample 19. A coating solution was prepared as follows.

A yellow coupler (Y-1) of 26.7 g, dye image stabilizer (ST-1) of 10.0 g, dye image stabilizer (ST-2) of 6.67 g, additive (HQ-1) and anti-irradiation dye (AI-3) were dissolved in a mixture of a high boiling solvent of 6.67 g and ethyl acetate of 60 ml. The resulting solution was dispersed in 220 ml of 10% gelatin solution containing 7.0 ml of 20% surfactant (SU-1) by a ultrasonic homogenizer to prepare a yellow coupler dispersion. The dispersion was mixed with a silver halide blue-sensitive emulsion (containing 8.68 g of silver) to obtain a coating solution for the 1st layer. Coating solutions for the 2nd to 7th layers were prepared in a similar manner to the 1st layer solution. A hardener (H-1) was added to each of the 2nd and 4th layers and a hardener (H-2) was added to the 7th layer. Surfactants (SU-2 and SU-3), as a coating aid were also added thereto to adjust surface-tension.

The addition .amount, unless otherwise noted, was expressed in terms of g per $m^2$ of the photographic material.

The layer constitution was as follows.

7th layer: Protective layer

| | |
|---|---|
| Gelatin | 1.00 g/$m^2$ |
| DIDP | 0.05 |
| Antistaining agent (HQ-2) | 0.002 |
| Antistaining agent (HQ-3) | 0.002 |
| Antistaining agent (HQ-4) | 0.004 |
| Antistaining agent (HQ-5) | 0.002 |
| Antimold (F-1) | 0.002 |

6th layer: UV absorbing layer

| | |
|---|---|
| Gelatin | 0.40 g/$m^2$ |
| UV absorbent (UV-1) | 0.10 |
| UV absorbent (UV-2) | 0.04 |
| UV absorbent (UV-3) | 0.16 |
| Antistaining agent (HQ-5) | 0.04 |
| DNP | 0.20 |
| PVP | 0.03 |
| Anti-irradiation dye (AI-2) | 0.02 |
| Anti-irradiation dye (AI-4) | 0.01 |

5th layer: Red-sensitive layer

| | |
|---|---|
| Gelatin | 1.30 g/$m^2$ |
| Red-sensitive silver bromochloride emulsion (Em-R) | 0.21 |
| Comparative cyan coupler C-1 | 0.47 |
| Dye image stabilizer (ST-1) | 0.20 |
| Antistaining agent (HQ-1) | 0.01 |
| HBS-1 | 0.20 |
| DOP | 0.20 |

4th layer: UV absorbing layer

| | |
|---|---|
| Gelatin | 0.94 g/m$^2$ |
| UV absorbent (UV-1) | 0.28 |
| UV absorbent (UV-2) | 0.09 |
| UV absorbent (UV-3) | 0.38 |
| Antistaining agent (HQ-5) | 0.10 |
| DNP | 0.40 |

3rd layer: Green-sensitive layer

| | |
|---|---|
| Gelatin | 1.40 g/m$^2$ |
| Green-sensitive silver bromochloride emulsion (Em-G) | 0.17 |
| Magenta coupler (M-1) | 0.23 |
| Dye image stabilizer (ST-3) | 0.20 |
| Dye image stabilizer (ST-4) | 0.17 |
| DIDP | 0.13 |
| DBP | 0.13 |
| Anti-irradiation dye (AI-1) | 0.01 |

2nd layer: Interlayer

| | |
|---|---|
| Gelatin | 1.20 g/m$^2$ |
| Antistaining agent (HQ-2) | 0.03 |
| Antistaining agent (HQ-3) | 0.03 |
| Antistaining agent (HQ-4) | 0.05 |
| Antistaining agent (HQ-5) | 0.23 |

-continued

| | |
|---|---|
| DIDP | 0.06 |
| Antimold (F-1) | 0.002 |

1st layer: Blue-sensitive layer

| | |
|---|---|
| Gelatin | 1.20 |
| Blue-sensitive silver bromochloride Emulsion (Em-B) | 0.26 |
| Yellow coupler (Y-1) | 0.80 |
| Dye image stabilizer (ST-1) | 0.30 |
| Dye image stabilizer (ST-2) | 0.20 |
| Antistaining agent (HQ-1) | 0.02 |
| Anti-irradiation dye (AI-3) | 0.01 |
| DNP | 0.20 |

Support: polyethylene-laminated paper

In the above, the addition amount of silver halide was expressed in terms of a silver-converted value.

Y-1

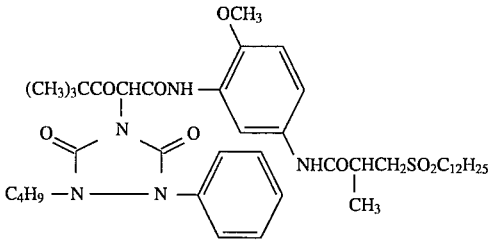

M-1

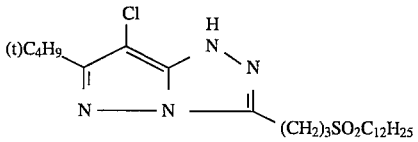

Comparitive cyan coupler C-1

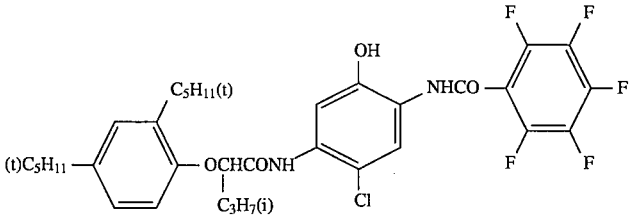

ST-1

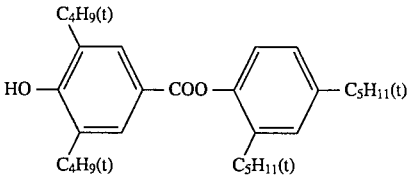

ST-2

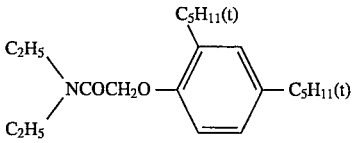

ST-3

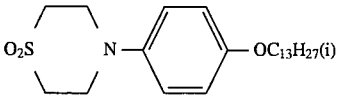

ST-4

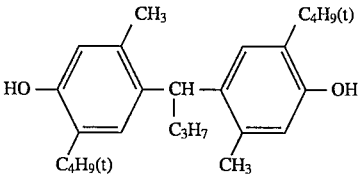

-continued
UV-1
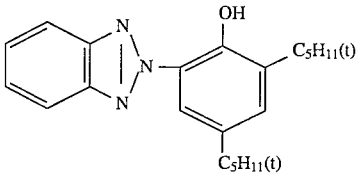
UV-2
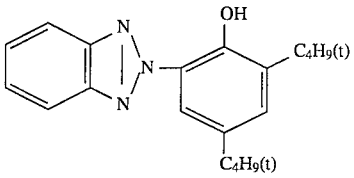
UV-3
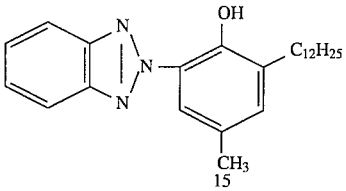
15
DBP: Dibutyl phthalate
DOP: Dioctyl phthalate
DNP: Dioctyl phthalate
DIDP:Diisodecyl phthalate
PVP: Polyvinyl pyrroridone
HQ-1
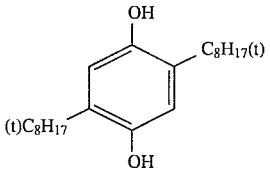
HQ-2
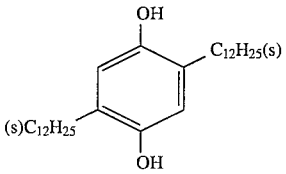
HQ-3
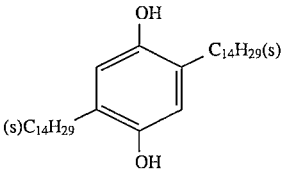
HQ-4
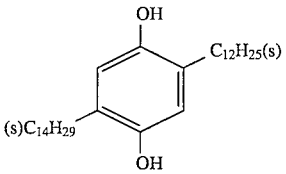
HQ-5
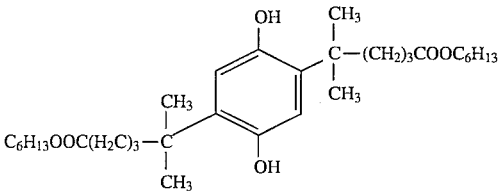
HBS-1
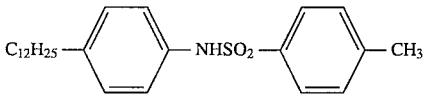
AI-1
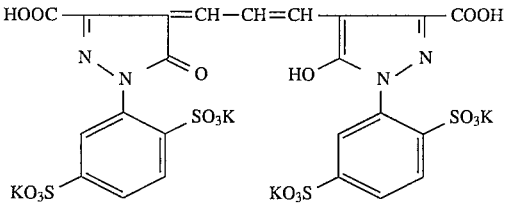
AI-2
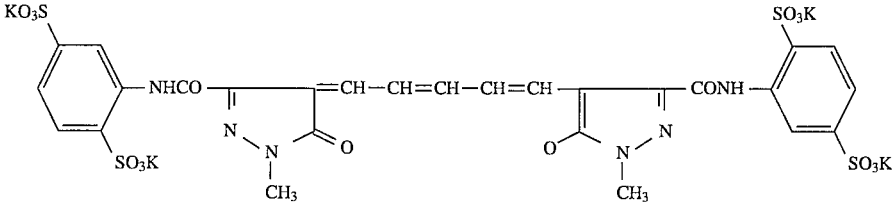
AI-3
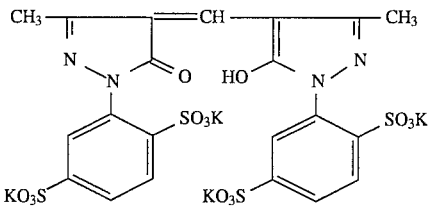
AI-4
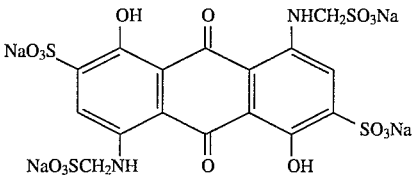

-continued

SU-1

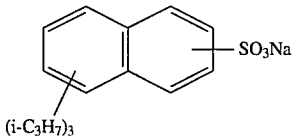

SU-2

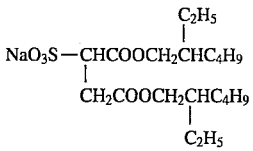

SU-3

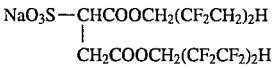

H-1

H-2

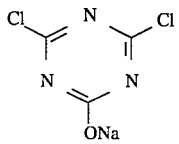

F-1

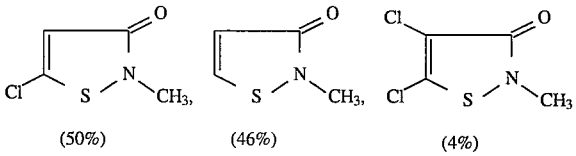

(50%) (46%) (4%)

mole ratio

Preparation of a blue-sensitive silver halide emulsion

To 1000 ml of 2% gelatin aqueous solution maintained at 40° C., the following solutions A and B were simultaneously added for 30 min., while being controlled to a pAg of 6.5 and pH of 3.0, and then solutions C and D were further added simultaneously for 180 min. while being controlled at pAg of 7.3 and pH of 5.5. The pH was controlled with sulfuric acid or sodium hydroxide. The pAg was controlled with the following controlling solution. The controlling solution was an aqueous halide solution comprising sodium chloride and potassium bromide in a ratio of 99.8:0.2, and the concentration thereof was 0.1 mol/liter when solutions A and B were mixed and 1 mol/liter when solutions C and D were mixed.

Solution A

| | |
|---|---|
| Sodium chloride | 3.42 g |
| Potassium bromide | 0.03 g |
| Water to make | 200 ml |

Solution B

| | |
|---|---|
| Silver nitrate | 10 g |
| Water to make | 200 ml |

Solution C

| | |
|---|---|
| Sodium chloride | 102.7 g |
| Potassium bromide | 1.0 g |
| Water to make | 600 ml |

Solution D

| | |
|---|---|
| Silver nitrate | 300 g |
| Water to make | 600 ml |

After the addition, the resulting emulsion was desalted using an aqueous 5% solution of Demol N (product of Kao-Atlas) and 20% solution of magnesium sulfate, and then mixed with an aqueous gelatin solution to obtain a silver bromochloride emulsion (EMP-1) comprising monodispersed, cubic crystal grains having an average grain size of 0.85 μm, a coefficient of variation of grain size (S/R) of 0.07 and chloride content of 99.5 mol %.

The thus-prepared emulsion EMP-1 was chemically sensitized for 90 min. at 50° C. using the following compounds to obtain a blue-sensitive silver halide emulsion (Em-B).

| | |
|---|---|
| Sodium thiosifate | 0.8 mg/mol AgX |
| Chloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of a green-sensitive silver halide emulsion

A monodispersed, cubic crystal grain emulsion (EMP-2), having an average grain size of 0.43 μm, a variation coefficient (S/R) of 0.08 and a chloride content of 99.5 mol% was prepared in the same manner as emulsion EMP-1, except that the addition time of A and B solutions, and that of C and D solutions were respectively varied.

The emulsion prepared (EMP-2) was chemically sensitized for 120 min. at 55° C. using the following compounds to obtaine a green-sensitive silver halide emulsion (Em-G).

| | |
|---|---|
| Sodium thiosifate | 1.5 mg/mol AgX |
| Chloroauric acid | 1.0 mg/mol AgX |
| Stabilizer (STAB-1) | $6 \times 10^{-4}$ mol/mol AgX |
| Sensitizing dye (GS-1) | $4 \times 10^{-4}$ mol/mol AgX |

Preparation of a red-sensitive silver halide emulsion

A monodispersed, cubic crystal grain emulsion (EMP-3), having an average grain size of 0.50 μm, a variation coefficient (S/R) of 0.08 and a chloride content of 99.5 mol % was prepared in the same manner as emulsion EMP-1, except that the addition time of A and B solutions, and that of C and D solutions were respectively varied.

The emulsion prepared (EMP-3) was chemically sensitized for 90 min. at 60° C. using the following compounds to obtain a red-sensitive silver halide emulsion (Em-R).

| | |
|---|---|
| Sodium thiosulfate | 1.8 mg/mol AgX |
| Chloroauric acid | 2.0 mg/mol AgX |
| Stabilizer (STAB-1) | $6 \times 10^{-4}$ mol/mol AgX |
| Sensitizing dye (RS-1) | $1 \times 10^{-4}$ mol/mol AgX |

A coefficient of variation of grain size was determined from a standard deviation (S) and average grain size (R) according to the following relation, $$S=\{\Sigma(R_i-R)^2/\Sigma n_i\}^{1/2}$$

wherein $R_i$ represents a grain size and $n_i$ represents number of grains having a grain size of $R_i$.

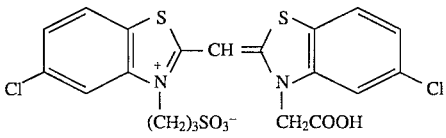

BS-1

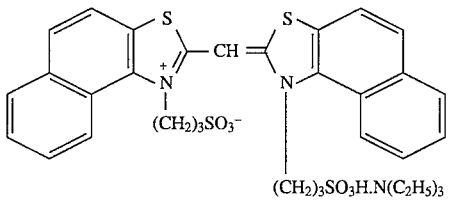

BS-2

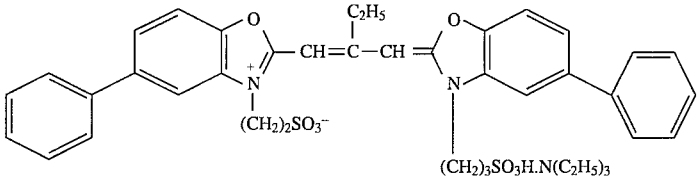

BS-3

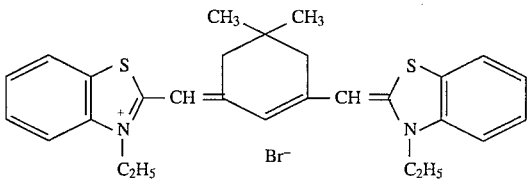

BS-4

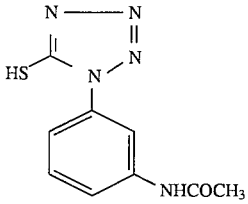

STAB-1

Next, samples 20 to 25 were prepared in the same manner as sample 19, except that cyan coupler C-1 of the 5th layer was replaced by equimolar coupler(s) as shown in Table 3, provided that, in case of two kinds of couplers used, a molar ratio of coupler a to coupler b is 1:4.

Thus prepared samples 19 to 25 were exposed to red light throughan optical wedge, and subjected to processing and sensitometry in the same manner as Example 1. The samples were visually evaluated with respect to color reproduction of the color imgae in the same manner as Example 2. Furthermore, the samples were tested with respect to samples were tested with respect to the dark and light stability in a similar manner to Example 1. Results thereof are shown in Table 3.

TABLE 5

| Sample | Coupler | | | Color | Dye residual ratio (%) | | |
|---|---|---|---|---|---|---|---|
| No. | a | b | Dmax | repro-duction | Drak | Light | Remarks |
| 19 | Comp. C-1 | | 2.32 | 3 | 94 | 64 | Comp. |
| 20 | Comp. C-1 | Inv. (III)-2 | 2.50 | 4 | 91 | 76 | Comp. |
| 21 | Comp. (III)-2 | | 2.54 | 4–5 | 60 | 77 | Comp. |
| 22 | Inv. (I)-2 | | 2.35 | 3 | 95 | 74 | Inv. |
| 23 | Inv. (I)-2 | Inv. (II)-3 | 2.63 | 4–5 | 91 | 79 | Inv. |
| 24 | Inv. (I)-2 | Inv. (III)-2 | 2.61 | 5 | 95 | 77 | Inv. |
| 25 | Inv. (I)-2 | Inv. (III)-6 | 2.60 | 5 | 95 | 77 | Inv. |

As can be seen from Table 3, samples containing an inventive cyan coupler were not only excellent in dye fastness (i.e., higher in the dye residual ratio) as compared to comparative samples 19 and 20 containing coupler C-1 or (III)-2, but also a combined use of a cyan coupler of formula (I) with a coupler of formula (II) or (III) led to a color dye image excellent in color reproduction. Particularly, a combination use of a coupler of formula (III) with a coupler of formula (I) achieved an enhanced improvement in color reproduction of the color image, as compared to that of the copler of formula (III) with the compartive coupler C-1. This was attributable unexpectedly to a synergistic effect of a coupler of formula (II) or (III) combined with a coupler of formula (I). It was also shown therefrom that the inventive samples displayed remarkably satisfactory characteriatics in light- keeping and dark-keeping stability (heat and moisture resistance) of the dye.

What is claimed is:

1. A silver halide color photographic light sensitive material comprising a support having thereon a silver halide emulsion layer wherein said silver halide emulsion layer contains a cyan coupler representedby the following formula (I),

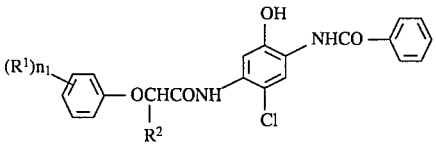

Formula (I)

wherein $R^1$ represents an unsubstituted alkyl group; $R^2$represents a hydrogen atom or an unsubstituted alkyl group having 1 to 10 carbon atoms; $n_1$ is an integer of 1 to 5.

2. The silver halide color photographic material of claim 1, wherein said silver halide emulsion layer further contains a cyan coupler represented by the following formula (II),

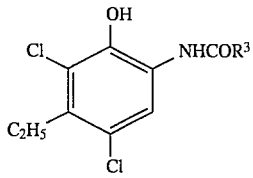

Formula (II)

wherein $R^3$ represents an alkyl group.

3. The silver halide color photographic material of claim 2, wherein said coupler of formula (I) is contained in an amount of 10 to 50%, based on the total amount of the couplers of formulas (I) and (II).

4. The silver halide color photographic material of claim 1, wherein said coupler of formula (I) is contained in an amount of 0.03 to 0.5 g per $m^2$ of the photographic material.

5. The silver halide color photographic material of claim 1, wherein said silver halide emulsion layer further contains a cyan coupler represented by the following formula (III),

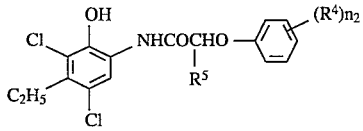

Formula (III)

wherein $R_4$ represents an unsubstituted alkyl group; $R^5$ represents a hydrogen atom or an alkyl group having 1 to 10 carbon atoms; $n_2$ is an integer of 1 to 5.

6. The silver halide color photographic material of claim 5, wherein said coupler of formula (I) is contained in an amount of 10 to 50%, based on the total amount of the couplers of formulas (I) and (III).

* * * * *